United States Patent [19]

Stahlecker

[11] Patent Number: 4,592,114

[45] Date of Patent: Jun. 3, 1986

[54] DRAFTING ROLLER ARRANGEMENT FOR SPINNING MACHINES

[75] Inventor: Fritz Stahlecker, Josef-Neidhart-Strasse 18,, 7347 Bad Überkingen, Fed. Rep. of Germany

[73] Assignees: Hans Stahlecker; Fritz Stahlecker, both of Fed. Rep. of Germany

[21] Appl. No.: 631,076

[22] Filed: Jul. 16, 1984

[30] Foreign Application Priority Data

Aug. 3, 1983 [DE] Fed. Rep. of Germany ..... 3327966

[51] Int. Cl.[4] ..... D01G 31/00; D01H 5/38

[52] U.S. Cl. ..... 19/0.25; 19/239; 19/246; 19/258; 19/288

[58] Field of Search ..... 19/0.25, 239, 246, 286, 19/287, 288, 291, 292, 258

[56] References Cited

U.S. PATENT DOCUMENTS 4,473,924 10/1984 Hartsmannsgruber et al. ..... 19/239
4,480,354 11/1984 Glock et al. ..... 19/0.25

FOREIGN PATENT DOCUMENTS 3,021,632 12/1981 Fed. Rep. of Germany.
3,048,481 7/1982 Fed. Rep. of Germany.
3,100,049 8/1982 Fed. Rep. of Germany.

*Primary Examiner*—Louis K. Rimrodt
*Assistant Examiner*—J. S. Olds
*Attorney, Agent, or Firm*—Barnes & Thornburg

[57] ABSTRACT

A drafting roller arrangement for spinning machines is disclosed having at least three pairs of rollers forming successive drafting zones in the conveying direction of the sliver and having a sliver stopping device assigned to the first pair of rollers that can be triggered by a disturbance. In front of the last drafting zone, a sliver condenser having guide surfaces narrowingly tapering in the conveying direction of the sliver is arranged. The sliver condenser is provided with a threading slot extending in the conveying direction of the sliver and is held by means of a holding device in such a way that it can be moved out of the drafting zone transversely to the conveying direction toward the side facing away from the threading slot. This arrangement accommodates restarting of the drafting arrangement without the sliver condenser interfering with the sliver supplied to the last drafting zone.

17 Claims, 7 Drawing Figures

Fig. 2
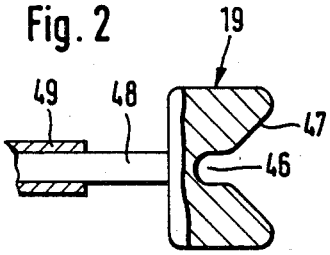
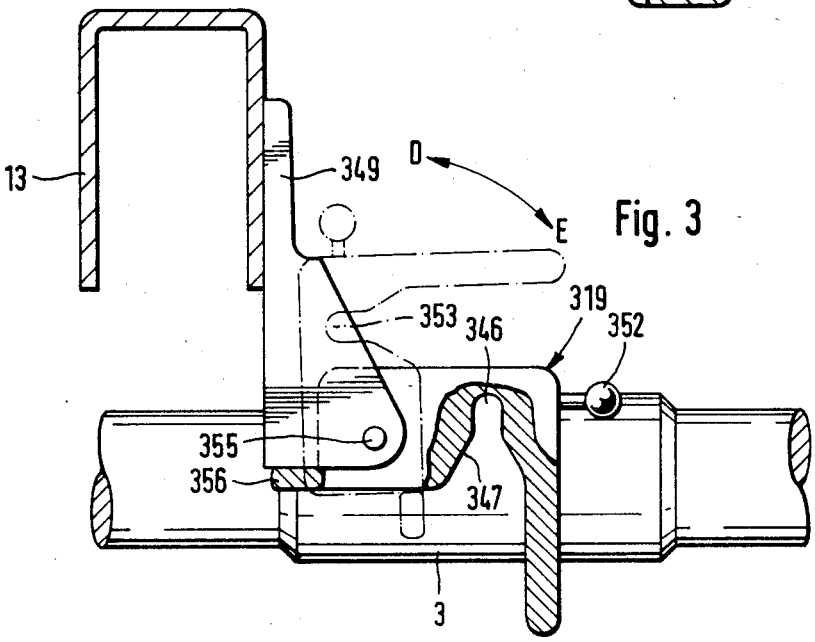
Fig. 3
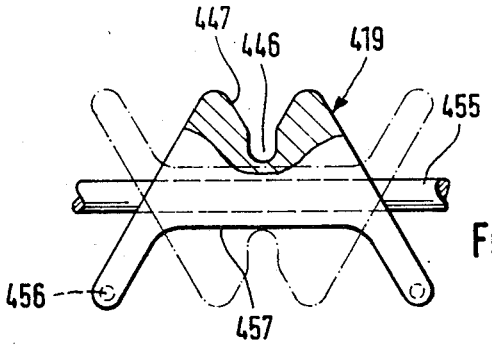
Fig. 4

Fig. 5
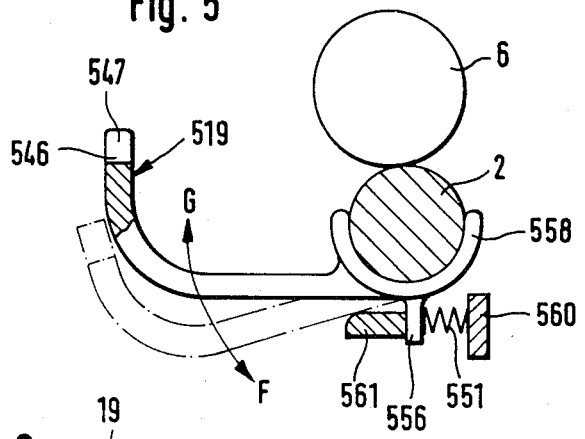
Fig. 6
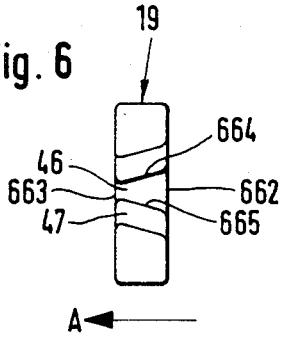
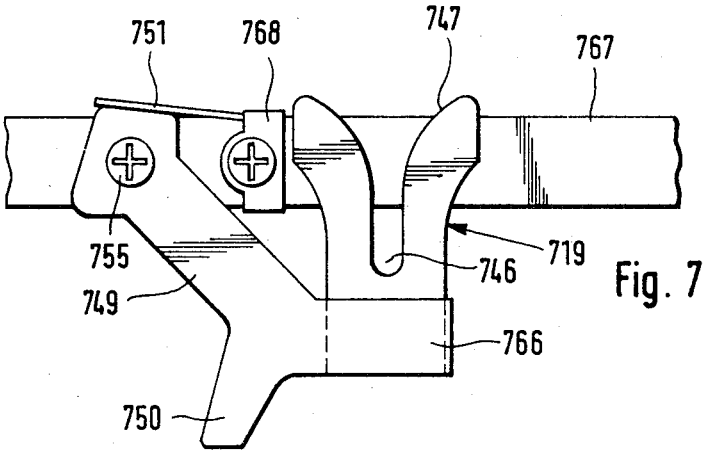
Fig. 7

DRAFTING ROLLER ARRANGEMENT FOR SPINNING MACHINES

BACKGROUND AND SUMMARY OF THE INVENTION

This invention relates to a drawing or drafting roller arrangement for spinning machines, having at least three pairs of rollers forming successive drafting zones in the conveying direction of a sliver and having a device to stop the sliver that can be triggered by a disturbance and is assigned to the first pair of rollers.

Drafting roller arrangements having a device to stop the sliver are known, for example, from German Published Unexamined Application (DE-OS) No. 30 48 481. These arrangements are especially useful in the case of high working speeds and slivers of a relatively large cross section because otherwise there is a relatively high loss of fiber material during a disturbance, especially in the case of a yarn breakage. When the sliver is started again after the feeding is interrupted, difficulties may arise concerning a correct introduction of the sliver into the roller pairs. These difficulties occur especially in front of the last drafting zone since the sliver that, is generally guided freely there over a relatively large distance. In the subsequent main drafting zone, the sliver is, as a rule, guided by means of a belt support so that the entry into the last pair of rollers does not present any difficulties.

In order to avoid these difficulties in the case of a drafting roller arrangement having three pairs of rollers, it is known from German Published Unexamined Application (DE-OS) No. 31 00 049 to arrange a holding means for the sliver after the pair of entry rollers and in front of the second drafting zone, said holding means for the sliver being operated at the same time as the stopping device for the sliver and clamping in the sliver. The sliver will then tear only after or downstream of this holding means so that the position of the forming tuft or fiberbeard is defined. The purpose is that during the restarting process, when the holding means for the sliver is opened, the entry of the sliver into the pairs of rollers is improved.

The present invention is based on the objective of improving the uniformity of the drafting and thus the uniformity of the forming yarn in the case of a drafting roller arrangement of the initially mentioned type, without making the restarting of the sliver after a stop more difficult.

This objective is achieved according to the invention by providing that a sliver condenser is arranged upstream of the last drafting zone, said sliver condenser having guide surfaces tapering in the conveying direction of the sliver and being provided with a threading slot extending in the conveying direction of the sliver. The sliver condenser is held by means of a holding means in such a way that it can be moved out of the drafting zone, transversely to the conveying direction, in the direction of the side facing away from the threading slot.

Especially in the case of slivers with a relatively large cross section, the sliver condenser makes the drawing of the yarn significantly uniform. However, the difficulty arises that the sliver does not enter into the condenser or enters only with great difficulty into the condenser when the sliver feeding device is turned on again, but rather bunches up in the area of the sliver condenser. In order to avoid this difficulty, it is provided that the sliver condenser, during the reentry of the sliver into the last drafting zone, is moved out of the activity range of the drafting zone. It will be returned to the sliver and will resume its function only when the entry of the sliver into the last drafting zone has been completed.

The use of sliver condensers in the case of drafting roller arrangements is known from German Published Unexamined Application (DE-OS) No. 30 21 632, where, however, these drafting roller arrangements are not provided with a stopping device for the sliver so that in the case of this construction, the problems caused by such a stopping device do not occur.

According to the invention, it is provided that the sliver condenser is selectively movable out of its operating position against a restoring force. The operator must therefore operate the sliver condenser only at the beginning of the restarting of the sliver, said condenser then automatically returning into its operational position. It is therefore not possible for the operator to forget to return the sliver condenser to its operating position.

In order to obtain uniform operating conditions, it is provided in a further development of the invention that the sliver condenser, in the operating position, rests against a stop.

In a further development of the invention, it is provided that the sliver condenser is mounted at a holding means so that it can be detached easily. It therefore becomes possible to exchange the sliver condenser guide in a simple matter in the case of wear or in the case of a change of the fiber materials to be processed.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 2 is a partial sectional view through the sliver condenser guide of the FIG. 1 arrangement, taken in the conveying direction of the sliver;

FIG. 3 is a partial sectional schematic view through a drafting arrangement according to the invention with a modified arrangement of a sliver condenser guide;

FIG. 4 is a partial sectional schematic view through another embodiment of a sliver condenser guide taken in the conveying direction of the sliver;

FIG. 5 is a partial sectional schematic view through another embodiment of a sliver condenser guide taken in a direction transversely to the conveying direction of the sliver;

FIG. 6 is a lateral view of a sliver condenser guide of FIG. 1, looking into a threading slot; and FIG. 7 is a view of another embodient of a sliver condenser guide taken in the conveying direction of the sliver.

DETAILED DESCRIPTION OF THE DRAWINGS

Figure 1:
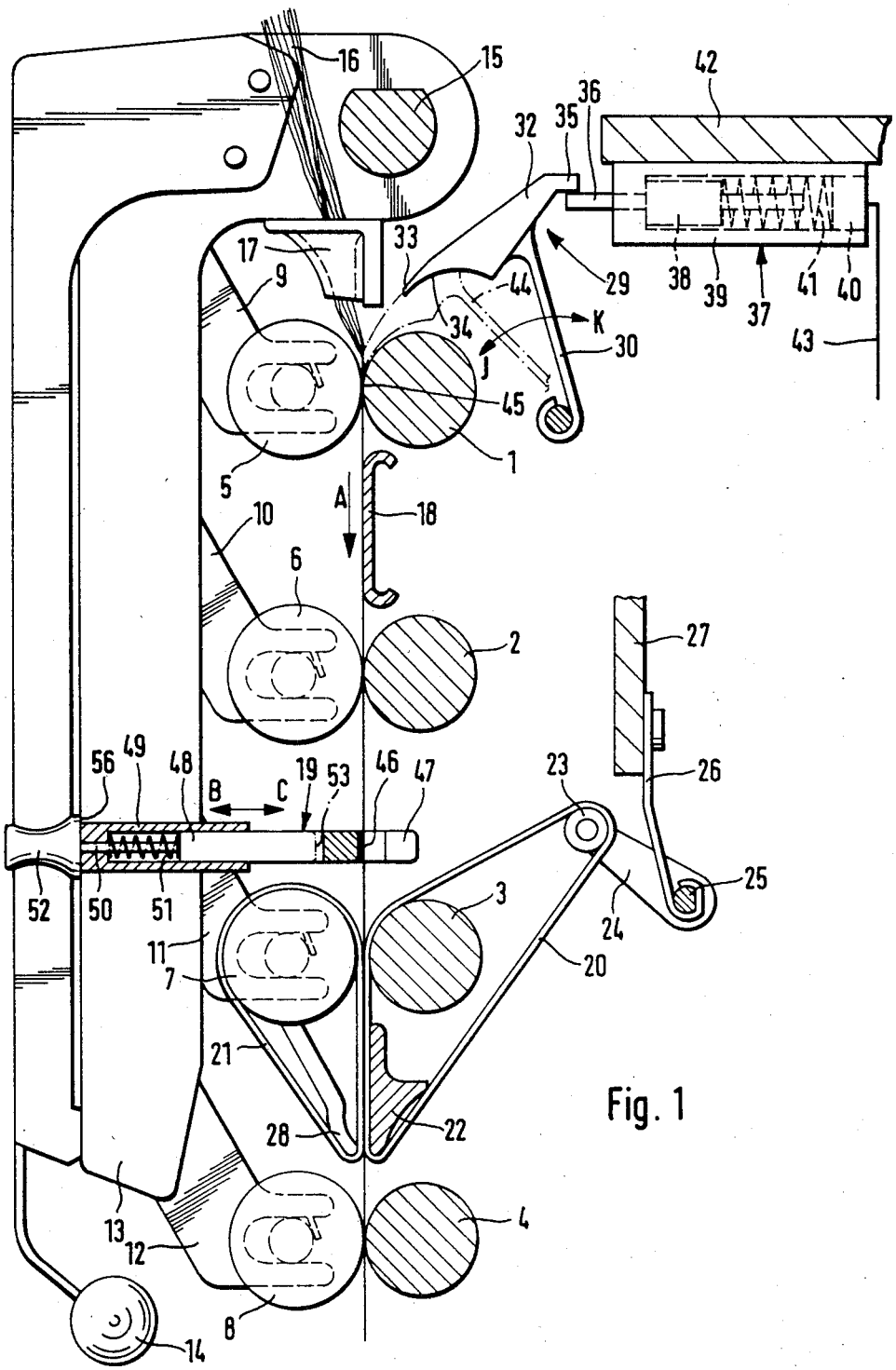
FIG. 1 is a lateral part-sectional view of a drawing roller arrangement having a sliver stopping device and a sliver condenser guide arranged in front of the last drafting zone, constructed in accordance with a preferred embodiment of the present invention.

The drawing roller arrangement shown in FIG. 1 has four pairs of rollers consisting of driven lower rollers 1, 2, 3 and 4 extending over several spinning points (of a spinning machine with plural spinning points) and of upper rollers 5, 6, 7, and 8 being pressed against said lower rollers with a predetermined load force. The upper rollers 5, 6, 7 and 8 are preferably dimensioned only for one spinning point or, as desired, in the form of twin pressure rollers are intended for two adjacent spinning points. The roller shafts of the upper rollers 5, 6, 7 and 8 are held in a support and weighting arm 13 by means of fork-type guides 9, 10, 11 and 12. Arm 13 can be swivelled around a holding rod 15 extending in longitudinal direction of the machine through several spinning points so that the upper rollers 5, 6, 7 and 8 can be lifted off the lower rollers 1, 2, 3 and 4 assigned to them by operating a handle 14.

A sliver 16 that is to be drawn or drafted enters a feeding mouth 17 in the direction of the Arrow A and then reaches the nip line 45 of the pair of entry rollers 1, 5. In the first drafting zone, the so-called predrafting zone, the sliver 16 is supported by means of a table 18 made of sheet metal between the pair of entry rollers 1, 5 and the second pair of rollers 2, 6. In the drafting zone following the second pair of rollers 2, 6, the so-called condenser zone, the sliver 16 is guided by means of a sliver condenser 19. The condenser 19 (also see FIG. 6) has a groove- or slot-type guide narrowing from the entry side 662 toward the exit side 663 so that a condensing effect is carried out on the sliver 16. The guiding surfaces 664 and 665 of which guide limit the guiding in the axial direction with respect to the rollers 3 and 7. The groove-shaped guide 46 of this condenser 19 is open toward the outside via a threading slot 47 extending in conveying direction A of the sliver. The threading slot 47, in a V-shaped manner, expands toward the outside (compare FIG. 2). This construction of the guide 46 and of the threading slot 47 is the same in all embodiments discussed in the following so that this feature does not have to be explained separately.

Following the third pair of rollers 3, 7, there is another drafting zone, the so-called main drafting zone, which is limited by the last pair of rollers, the exit pair of rollers 4, 8. In this main drafting zone, the sliver 16, is supported by a lower belt or band 20 and an upper belt or band 21 and is guided to the proximity of the pair of rollers 4, 8. The lower belt 20 is placed around the pertaining lower roller 3 and a deflection guide 22 as well as a tension pulley 23. The tension pulley 23 which is arranged between the lower rollers 2 and 3 is disposed on a swivel arm 24 which is held by means of a leaf spring in a position that puts the lower belt 20 under tension, arm 24 being pivotably supported at a stationary shaft 25. The leaf spring 26, which is fastened at a support 27, subjects the swivel shaft 25 to a torque. The upper belt 21 is placed around the upper roller 7 and a guide 28.

The drafting roller arrangement is arranged vertically or approximately vertically. The drafting in the individual drafting zones is achieved by the fact that the lower rollers 1, 2, 3 and 4 are driven at varying speeds that increase in the sliver conveying direction.

A sliver stopping device 29 is assigned to the pair of entry rollers 1, 5, said sliver stopping device 29 carrying a plastic part 32 forming a wedge 33 on a pivoted lever 30. When the lever 30 swivels in the direction of arrow J from the operating position shown in sold lines into the dash-dotted postion 44, wedge 33 is supplied to the clamping gap 45 of the pair of entry rollers 1, 5. The plastic part 32, which has an essentially circular contour 34 on its side facing the lower roller 1, is dimensioned to maintain a distance from the lower roller 1. Because of its own weight, part 32 falls in the direction of the pair of entry rollers 1, 5 and the wedge 33 is pulled into the clamping gap 45 so that it lifts the upper roller 5 off the continuing lower roller 1 and stops it. In the process, the sliver 16 is clamped against the upper roller 5 by the plastic part 32.

The sliver stopping device 29 is held in the operating postion by means of a locking device 37 which is triggered in the case of a disturbance, especially a yarn breakage. The locking device 37 contains a housing 39 in which a piston 38 is slidably guided. A bolt 36 is mounted at piston 39 and projects to the outside. An extension 35 of the plastic part 32 of the sliver stopping device 29 rests on this bolt 36. By means of a spring 41, the piston 38 is held in the operating position. The piston 38 is provided with an extension located on the inside of the spring 41, said extension being disposed opposite an electromagnet 40. The electromagnet 40, which via a line 43 is connected with a yarn monitor that is not shown, is briefly excited by the response of the thread monitor so that the piston 38 with the bolt 36 is pulled back unlocking the sliver stopping device 29. The locking device 37 is mounted at a support 42 of the machine frame.

When the sliver stopping device 29 is operated in the manner described above, the sliver 16 is clamped at the upper roller 5. Since the effect of the following pair of rollers 2, 6; 3, 7; and 4, 8 is not interrupted, the sliver 16 tears in the area between the pairs of rollers 1, 5 and 2, 6 and there forms a tuft or fiberbeard. This fiberbeard is located in the area of the guide table 18. When the feeding of the sliver 16 is turned back on by turning back the sliver stopping device 29 in the direction of the arrow into the shown operating position, the sliver must enter into the subsequent pairs of rollers 2, 6; 3,7; and 4, 8. The entry into the pair of rollers 2, 6 in practice presents no difficulties because, in this area, the sliver 16 is not yet drawn very much and is thus relatively stable. Difficulties arise, however, in the area between the pair of rollers 2, 6 and the pair of rollers 3, 7 because the sliver 16 may bunch up at the sliver condenser 19 so that it no longer properly reaches the pair of rollers 3, 7. In order to avoid the difficulties connected with the sliver condenser 19 when the the drawing roller arrangement is restarted, it is provided that the sliver guide 19 can be moved out of the area in which the sliver 17 is running during the restarting. For this purpose, the plate-shaped sliver condenser 19 is provided with a bolt 48 guided in a sliding guide 49 which is mounted at the supporting and weighting arm 13. From the bolt 48, a connecting bolt 50 extends through the sliding guide 49 where a control button 52 is mounted. On the inside of the sliding guide 49, a pul-back spring 51 is arranged, against the effect of which the bolt 48 with the sliver condenser 19 can be pulled into the sliding guide 49 in the direction of Arrow B. When the button 52 is released, the spring 51 presses the sliver condenser 19 back into its operating position in the direction of the Arrow C until the button 52 with its stopping face 56 rests against the sliding guide 49. The sliding guide 49 is arranged in such way that the rounded bottom of the guide 46 is adjusted precisely with respect to the sliver 16.

When the sliver condenser 19 is moved out, the end of the sliver 16 forming the tuft or fiberbeard meets the lower belt 20 or the upper belt 21 and by these is conveyed between the rollers 3 and 7. Especially when the drafting roller arrangement is arranged with a slight slope toward the vertical, i.e., in such a way that the lower rollers 1 to 4 are located somewhere below the upper rollers 5 to 8, the tuft or fiberbeard of the sliver 16 will preferably reach the area of the lower belt 20 which, by means of the tension pulley 23, is pulled into the area between the lower rollers 2 and 3 and which runs diagonally in the direction of the contact point between the lower roller 3 and the upper roller 7.

In the case of the embodiment according to FIG. 3—seen in the conveying direction of the sliver 16—a holding means 349 is mounted at the supporting and weighting arm 13 shortly upstream of the lower roller 3 and the pertaining upper roller 7 that is not shown. Holding means 349 has an essentially U-shaped cross section and is provided with receiving boreholes in both legs, into which a shaft 355 of a sliver condenser 319 is clipped. The shaft 355 extends in parallel to the conveying direction of the sliver 16 so that the sliver condenser 319 can be swivelled upward or downward corresponding to the direction of the Arrows D and E. The swivelling into the dash-dotted non-operational position takes place manually, for which purpose the sliver condenser 319 has a handle 352. The sliver condenser 319, which is provided with a tapering guide 346 and a threading slot 347 is provided on the side facing away from the shaft 355 with a thickened lengthening so that also in the dash-dotted non-operational position, the center of gravity of the sliver condenser 319 is located betwen the shaft 355 and the slide way of the not shown sliver so that the sliver condenser 319, after the handle 352 is released, automatically falls into its operational position. This operational position is secured by a stop 356 of the sliver condenser 319 that rests against a stop face of the holding means 349.

In the case of the embodiment according to FIG. 4, a sliver condenser 419 is provided that is pivotably arranged on a shaft 455 extending in parallel to the shafts of the rollers 1 to 8. The sliver guide 419, in the area facing away from the tapering guide 446 has a roller-shaped area 457 that is coaxial with the shaft 455. The sliver guide 419 shown in the non-operational position, with the roller-shaped area 457, is in the non-operational position located in the path of the sliver so that the reentering sliver starts against this roller-shaped area 457. By means of the friction between the sliver and the sliver condenser 419, it is taken along and is turned back into the dash-dotted operational position, the guide 446, via the threading slot 447, moving into the area of the sliver. In this operational position, the sliver guide 419 with the stops 456 will then rest against stationary stop faces that are not shown.

In FIG. 5, a sliver condenser 519 is provided that can be swivelled around a swivel axis extending transversely to the conveying direction of the not shown sliver into the non-operational position shown by an interrupted line corresponding to the Arrows G and F. The swivel axis in this embodiment is the lower roller 2 onto which the sliver guide 519 is clipped with an approximately half-cylindrical bearing receiving means 558. A bent arm extends away from said receiving means 558, at the end of which the guide 546 is provided having the threading slot 547. In the area of the receiving means 558, the sliver condenser 519 is provided with a stop 556 which, in the operational position, rests against a stationary stop 561. On the other side of the stop 556, a return spring 551 is provided that supports itself at a part 560 of the machine frame and presses the sliver condenser 519 back into its operational position for a restarting of the sliver 16.

In the case of the embodiment according to FIG. 7, a sliver condenser 719 made of plastic or ceramics is provided which has a threading slot 747 having convexly arched flanks connecting to the groove-shaped guide 746 of said sliver condenser 719 tapering in the conveying direction of the sliver 16. The sliver condenser 719 is glued to a projection 766 of a holding means 749 which, by means of a swivelling shaft 755 formed by a fastening screw, is mounted at a rail 767. The swivelling shaft 755 extends in parallel to the running direction of the not shown sliver 16 and the rail 767 extends transversely to it. At the rail 767, a holding means 768 having a pull-back spring 751 developed as a leaf spring is mounted which rests against a surface of the holding means 749 extending, in the shown operational position, in parallel to the leg of the pull-back spring 751. The holding means 749 is provided with a projection 750 serving as an operating handle. The holding means 749, together with the sliver condenser 719, can be swivelled clockwise against the effect of the pull-back spring 751 into a non-operational position that is not shown. After the holding means 749 is released, the pull-back spring 751 presses the holding means 749 with the sliver condenser 719 back into its operational position.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A drafting arrangement for drafting sliver for spinning machines comprising:

at least three pairs of drafting rollers forming at least a first, second and third drafting zone in the conveying direction of a sliver, sliver stopping means assigned to the first drafting zone for stopping the sliver in response to a detected disturbance, a sliver condenser arranged upstream of the last drafting zone in the conveying direction of a sliver and having sliver guide surfaces tapering narrowingly in the direction of sliver travel, said sliver condenser being provided with threading slot means, and condenser holder means for holding the condenser in such a way that it can be selectively moved out of the last drafting zone in the conveying direction of a sliver transversely to the sliver conveying direction in a direction away from the threading slot means side of the sliver condenser.

2. An arrangement according to claim 1, wherein restoring force means are provided for pushing the sliver condenser towards its operational position and, wherein the sliver condenser can be selectively moved out of its operational position against the force of the restoring force means.

3. An arrangement according to claim 2, wherein the sliver condenser rests against a stop when in the operational position.

4. An arrangement according to claim 2, wherein the sliver condenser is loaded by a pull-back spring of the restoring force means.

5. An arrangement according to claim 2, wherein the condenser holding means are designed in such a way that the weight of the movable parts of the holding means and the sliver condenser forms the restoring force means.

6. An arrangement according to claim 1, wherein the holding means is a sliding guide that extends transversely to the conveying direction of the sliver.

7. An arrangement according to claim 1, wherein the holding means is a holder that can be swivelled around a swivel shaft.

8. An arrangement according to claim 7, wherein the swivel shaft extends in parallel to the conveying direction of the sliver.

9. An arrangement according to claim 7, wherein the swivel shaft extends in parallel to the shafts of the drafting rollers.

10. An arrangement according to claim 1, wherein the holding means is mounted at a supporting and weighting arm.

11. An arrangement according to claim 1, wherein the holding means is mounted at a rail extending in parallel to the drafting rollers.

12. An arrangement according to claim 9, wherein the holding means includes a swivel arm which is held at one of the rollers by means of a bearing means.

13. An arrangement according to claim 1, wherein the sliver condenser is disposed on a shaft extending in parallel to the drafting rollers and has a roller-shaped outer surface in the area facing away from the threading slot means.

14. An arrangement according to claim 1, wherein the sliver condenser is mounted at the condenser holding means so that it can be detached easily.

15. An arrangement according to claim 1, wherein the sliver condenser is made of a plastic or ceramic material.

16. An arrangement according to claim 1, having three drafting zones wherein the sliver condenser is disposed between the second and third drafting zone.

17. An arrangement according to claim 1, wherein a sheet material guide table is disposed between the first and second drafting zones to aid in guiding the sliver, wherein the sliver condenser is disposed between the second and third drafting zone, and wherein belt guide means are provided at the third drafting zone to guide the sliver.

* * * * *